US007261805B2

(12) United States Patent
Grove et al.

(10) Patent No.: US 7,261,805 B2
(45) Date of Patent: Aug. 28, 2007

(54) PROCESS FOR CATALYTIC DEWAXING AND CATALYTIC CRACKING OF HYDROCARBON STREAMS

(75) Inventors: Michael T. Grove, New Orleans, LA (US); Randall D. Partridge, Callfon, NJ (US); Terry E. Helton, Bethlehem, PA (US); David A. Pappal, Haddonfield, NJ (US); Philip J. Angevine, Woodbury, NJ (US); Dominick N. Mazzone, Wenonah, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 410 days.

(21) Appl. No.: 10/429,120

(22) Filed: May 2, 2003

(65) Prior Publication Data

US 2004/0004020 A1 Jan. 8, 2004

Related U.S. Application Data

(63) Continuation-in-part of application No. 09/256,068, filed on Feb. 24, 1999, now abandoned.

(51) Int. Cl.
*C10G 69/02* (2006.01)
*C10G 47/00* (2006.01)

(52) U.S. Cl. ..... 208/49; 208/27; 208/62; 208/66; 208/108

(58) Field of Classification Search ..... 208/27, 208/49, 62, 66, 108
See application file for complete search history.

(56) References Cited

U.S. PATENT DOCUMENTS 4,975,177 A * 12/1990 Garwood et al. ..... 208/27
5,084,159 A * 1/1992 Abdo et al. ..... 208/109

FOREIGN PATENT DOCUMENTS

EP 189648 A1 * 8/1986

* cited by examiner

*Primary Examiner*—Glenn Caldarola
*Assistant Examiner*—Prem C. Singh
(74) *Attorney, Agent, or Firm*—Jeremy J. Kliebert; Lawrence E. Carter

(57) ABSTRACT

A process for upgrading a hydrocarbon feedstock containing waxy components and having an end boiling point exceeding 650° F., which includes contacting the feedstock at superatmospheric hydrogen partial pressure with an isomerization dewaxing catalyst that includes ZSM-48 and contacting the feedstock with a hydrocracking catalyst to produce an upgraded product with a reduced wax content. Each catalyst is present in an amount sufficient to reduce the cloud point and the pour point of the feedstock at a conversion of greater than about 10%, and an overall distillate yield of greater than about 10% results from the process.

9 Claims, 6 Drawing Sheets

PROCESS FOR CATALYTIC DEWAXING AND CATALYTIC CRACKING OF HYDROCARBON STREAMS

CROSS-REFERENCE TO RELATED APPLICATIONS

This application is a continuation-in-part of U.S. patent application Ser. No. 09/256,068 filed Feb. 24, 1999, now abandoned.

BACKGROUND OF THE INVENTION

The present invention relates to the catalytic dewaxing of hydrocarbon streams. In particular, the present invention relates to a catalyst combination that provides a high distillate yield with a reduced pour point and cloud point.

Most lubricating oil feedstocks must be dewaxed in order to produce lubricating oils which will remain fluid down to the lowest temperature of use. Dewaxing is the process of separating or converting hydrocarbons which solidify readily (i.e., waxes) in petroleum fractions. Processes for dewaxing petroleum distillates have been known for a long time. As used herein, dewaxing means removal of at least some of the normal paraffin content of the feed. The removal may be accomplished by isomerization of n-paraffins and/or cracking.

Dewaxing is required when highly paraffinic oils are to be used in products which need to flow at low temperatures, i.e., lubricating oils, heating oil, diesel fuel, and jet fuel. These oils contain high molecular weight straight chain and slightly branched paraffins which cause the oils to have high pour points and cloud points. In order to obtain adequately low pour points, these waxes must be wholly or partly removed or converted. In the past, various solvent removal techniques were used, such as MEK (methyl ethyl ketone-toluene solvent) dewaxing, which utilizes solvent dilution, followed by chilling to crystallize the wax, and filtration.

The decrease in demand for petroleum waxes as such, together with the increased demand for gasoline and distillate fuels, has made it desirable to find processes which not only remove the waxy components but which also convert these components into other materials of higher value. Catalytic dewaxing processes achieve this end by either of two methods or a combination thereof. The first method requires the selective cracking of the longer chain n-paraffins, to produce lower molecular weight products which may be removed by distillation. Processes of this kind are described, for example, in *The Oil and Gas Journal*, Jan. 6, 1975, pages 69 to 73 and U.S. Pat. No. 3,668,113. The second method requires the isomerization of straight chain paraffins and substantially straight chain paraffins to more branched species. Processes of this kind are described in U.S. Pat. No. 4,419,220 and U.S. Pat. No. 4,501,926.

In order to obtain the desired selectivity, previously known processes have used a zeolite catalyst having a pore size which admits the straight chain n-paraffins, either alone or with only slightly branched chain paraffins, but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282 and 4,247,388. A dewaxing process employing synthetic offretite is described in U.S. Pat. No. 4,259,174. A hydrocracking process employing zeolite beta as the acidic component is described in U.S. Pat. No. 3,923,641.

An improved dewaxing process is disclosed in U.S. Pat. No. 4,419,220 to La Pierre et al., the entire contents of which is incorporated herein by reference. This patent discloses that hydrocarbons such as distillate fuel oils and gas oils may be dewaxed primarily by isomerization of the waxy components over a zeolite beta catalyst. The process may be carried out in the presence or absence of added hydrogen, although operation with hydrogen is preferred. This process can be used for a variety of feedstocks including light gas oils, both raw and hydrotreated, vacuum gas oils and distillate fuel oils obtained by Thermofor catalytic cracking (TCC).

Although catalytic dewaxing (whether shape selective dewaxing or isomerization dewaxing) is an effective process, it has some limitations. A catalytic dewaxing process removes wax, but it does not change the end point of the product to a great extent. The problem is most severe when using a shape selective zeolite catalyst, such as ZSM-5, which selectively cracks the normal and slightly branch chain paraffins, but leaves most other components untouched. Thus, the feeds to most shape selective catalytic dewaxing processes are selected based on the desired product because the end point of the product usually sets the end point of the feed. This limits the available feedstocks, since these dewaxing processes can be used to dewax heavier feedstocks, but the heavier feedstocks cannot produce light products.

U.S. Pat. No. 4,446,007 to Smith, which is incorporated herein by reference, discloses a process for producing a relatively high octane gasoline by-product from the cracking of normal paraffins by increasing the hydrodewaxing temperature to at least 360° C. within about seven days of start-up. This approach improves the economics of the dewaxing process by making the light by-products (the gasoline fraction) more valuable, but does not address the end-point problem. As a consequence, Smith does not take full advantage of the ability of the process to tolerate heavier feeds.

Other dewaxing processes reduce the pour point and cloud point of waxy feeds through the use of catalysts which isomerize paraffins in the presence of aromatics. These processes typically operate at relatively high temperatures and pressures, which results in extensive cracking and thereby degrades useful products to less valuable light gasses.

SUMMARY OF THE INVENTION

In accordance with the present invention, a process for upgrading a hydrocarbon feedstock is provided. The feedstock has a cloud point greater than 0 F, an ASTM D2887 end boiling point exceeding 650 F, and a pour point greater than 0 F, and contains waxy components. The process combines a hydrocracking catalyst and an isomerization catalyst under hydroprocessing conditions to provide an overall distillate yield of greater than about 10%, and preferably greater than about 30%. For the purposes of the present invention, distillate is defined as that portion of the hydrocarbon stream which has a boiling range of approximately 330 F to 730 F, as measured by ASTM D2887.

The feedstock is contacted at superatmospheric hydrogen partial pressure with an isomerization dewaxing catalyst that includes ZSM-48 to produce a dewaxed product. The dewaxed product is then contacted with a hydrocracking catalyst to upgrade the dewaxed product. Each of the catalysts has a hydrogenation component, and each catalyst is present in an amount sufficient to reduce the cloud point and the pour point of the feedstock by at least 5° F. and with a 650° F.+ conversion of greater than about 10%. For the purposes of the present invention, conversion is defined as the percentage of 650° F.+ feedstock that is converted to lighter materials. The process results in a pour point reduction of at least 10° C. and an overall distillate yield greater than about 10%.

In another embodiment, a catalytic hydrotreating process precedes the catalytic isomerization dewaxing process. The feedstock is first contacted with a hydrocracking catalyst and subsequently contacted with an isomerization dewaxing catalyst. The order of the steps can be changed without a significant decrease in the yield. The present invention also includes an embodiment in which the hydrocracking catalyst and the isomerization dewaxing catalyst are present in a physical mixture, are combined to form a single combination catalyst by coextrusion, or are stacked in a layered configuration. When the two catalysts are combined, the process can be carried out in a single reactor where the two reactions proceed simultaneously In the preferred embodiment, the reduction in pour point is at least about 65 F and the overall distillate yield from the process of the invention is greater than 50 weight %. The process can be carried out in any suitable catalytic reactor, with co-current trickle flow reactors, countercurrent flow reactors, ebullated fluid bed reactors and moving bed reactors being preferred.

The hydrogenation component for each of the hydrocracking and isomerization catalysts can be cobalt (Co), molybdenum (Mo), nickel (Ni), tungsten (W), a Group VIII noble metal (i.e., platinum (Pt), palladium (Pd), iridium (Ir), rhodium (Rh), ruthenium (Ru), and osmium (Os) or a combination thereof. Platinum is a preferred hydrogenation component for the catalysts, but other desirable hydrogenation components can be used, such as palladium or a platinum/palladium combination. The cracking component of the hydrocracking catalyst is selected from the group consisting of zeolite X, zeolite Y, REY, USY, zeolite beta, ZSM-12, ZSM-20, MCM-41, MCM-68, SAPO-37 and amorphous silica-alumina. The relative amounts of the hydrocracking and isomerization catalysts in the reactor can vary, depending on the fluidity of the feedstock and the desired extent of dewaxing and conversion. The preferred ratio of dewaxing catalyst to hydrocracking catalyst is from about 0.1:1 to about 10:1, with a most preferred ratio of from about 0.5:1 to about 5:1.

The hydroprocessing conditions in the process of the invention may vary depending on the feedstock and specific catalysts used. In the preferred embodiment, the hydroprocessing conditions include a temperature of about 400-1000 F, a hydrogen partial pressure of about 200 to 3000 psi, a hydrogen circulation rate of about 100 to 10,000 SCF/bbl, and a liquid hourly space velocity of about 0.1 to 20.

Previous dewaxing processes have reduced the pour point and cloud point of heavy hydrocarbon feedstocks to acceptable levels, but they have produced more than a desirable amount of naphtha and light gas. The present invention overcomes the deficiencies in previously used dewaxing processes by reducing the pour point and the cloud point of the feed to acceptable levels while maximizing the yields of diesel fuel and heating oil and minimizing the yields of naphtha and light gas.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
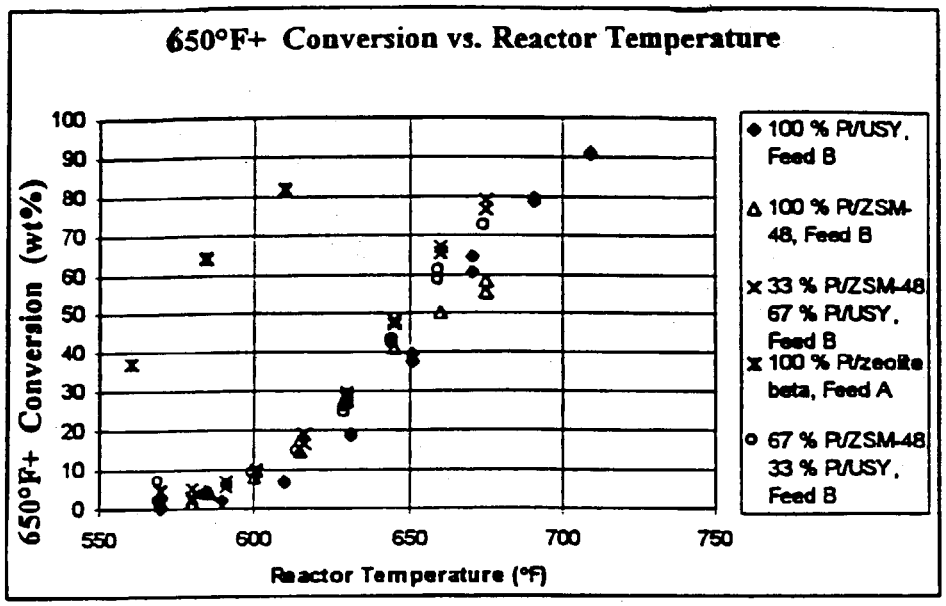
FIG. 1 is a plot of the 650° F.+ Conversion versus the Reactor Temperature for five different catalyst fills.

Many dewaxing processes that are presently being used reduce the pour and cloud point of a hydrocarbon stream to acceptable levels at the price of producing more than a desirable amount of naphtha and light gas. An ideal economic dewaxing process would reduce the pour point of the feed to acceptable levels while maximizing the yields of diesel fuel and heating oil and minimizing the yields of naphtha and light gas. Previous dewaxing processes have utilized ZSM-5 for shape-selective catalytic dewaxing or zeolite beta catalysts either alone or in combination with a Pt/USY catalyst for isomerization dewaxing.

Isomerization Dewaxing ("IDW") technology is currently employed to lower the pour and cloud points of petroleum oils to acceptable levels while minimizing the amount of naphtha and light gas. This goal is obtained through a series of mechanisms. The ideal end result is that the zeolite beta catalyst selectively isomerizes paraffins in the presence of aromatics. However, zeolite-based IDW also involves some conversion reactions, thereby resulting in significant yields of naphtha and $C_{4-}$ gases. Distillate Dewaxing ("DDW") catalysts accomplish pour reduction via shape selective cracking, wherein the cracked paraffins and monomethyl paraffins are converted to naphtha and $C_{4-}$ gases. The present invention utilizes a more ideal (i.e., less unwanted side reactions) IDW step and a selective hydrocracking step. By using both technologies, the distillate yields (330-730 F) are improved relative to prior art processes.

In the present invention, heavy hydrocarbon streams are processed using an isomerization catalyst in series with a distillate selective hydrocracking catalyst to maximize distillate yields while producing a quality fuel with an acceptable pour point and cloud point. An isomerization dewaxing catalyst is selected which reduces the pour point of a fuel at lower conversion so that the distillate-selective hydrocracking catalyst can produce more of the desirable distillate products, while producing fewer unwanted light gases and naphtha. The combination of catalysts used in the present invention produces distillate yields that are significantly higher than the yields produced by prior art catalysts.

As used in describing the present invention, the cloud point of an oil is the temperature at which paraffin wax or other solid substances begin to crystallize or separate from the solution, imparting a cloudy appearance to the oil when the oil is chilled under prescribed conditions. The conditions for measuring cloud point are described in ASTM D-2500. The pour point of an oil is the lowest temperature at which oil will pour or flow when it is chilled without disturbance under definite conditions. The conditions for measuring pour point are described in ASTM D-97.

The process of the present invention dewaxes hydrocarbon streams, such as hydrocracked bottoms, diesel fuels, and hydrotreated vacuum gas oils, using a noble metal/ZSM-48 catalyst, preferably a Pt/ZSM-48 catalyst, either alone or in combination with a noble metal/USY catalyst to produce petroleum oils with acceptable pour and cloud points while maximizing the yield of distillate boiling range materials. The Pt/ZSM-48 catalyst is very effective at reducing the pour points of hydrocracked bottoms, diesel fuels and treated straight run gas oils at low conversion. Previous IDW catalysts (for example, Pt/zeolite) reduced the pour point at a much higher conversion than Pt/ZSM-48. When ZSM-48 is combined with USY, the distillate yields can be maximized while the light gas and naphtha yields are minimized.

Figure 4:
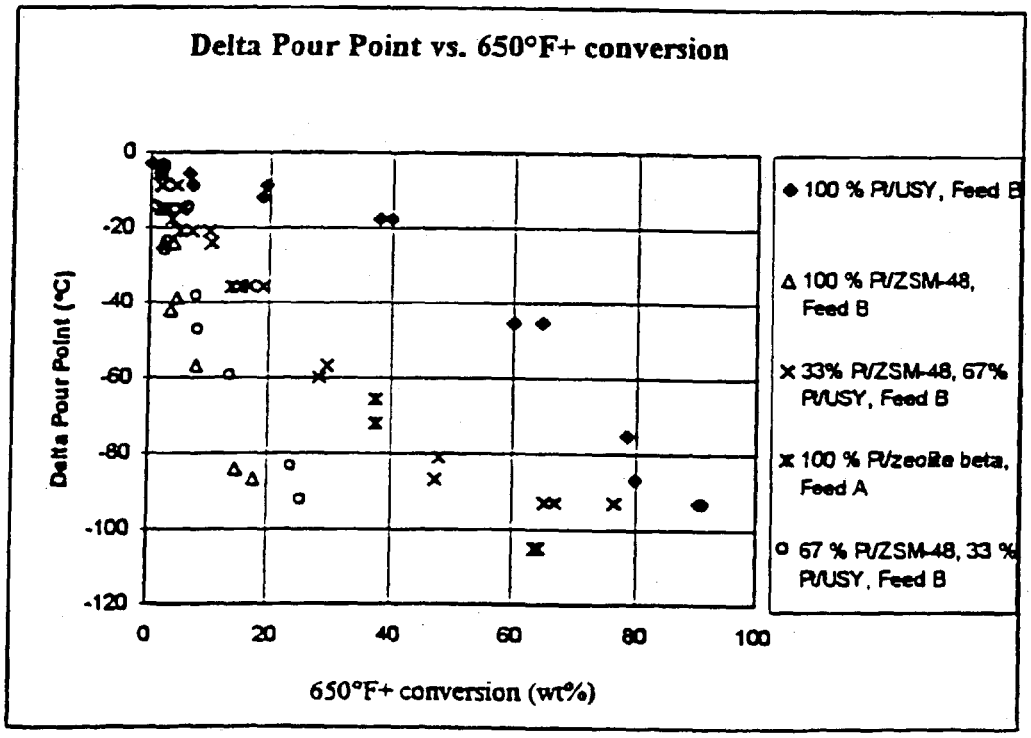
FIG. 4 is a plot of Delta Pour Point versus 650° F.+ Conversion for five different catalyst fills.

The Pt/ZSM-48 catalyst alone has significant dewaxing capabilities. FIG. 4 shows that at low 650° F.+ conversions (between 10 and 20 wt %), its product pour point is from 30 to 50° C. lower than the 100% Pt/zeolite catalyst and 50-80° C. lower than the 100% Pt/USY catalyst. Another advantage of the ZSM-48 catalyst is the low naphtha and light gas yields when compared to the Pt/zeolite catalyst. However, Pt/ZSM-48's activity is lower than the conventional catalyst in terms of both conversion and dewaxing. Distillate yields (330-730° F.) are also lower for the Pt/ZSM-48 catalyst compared to the Pt/zeolite.

Figure 8:
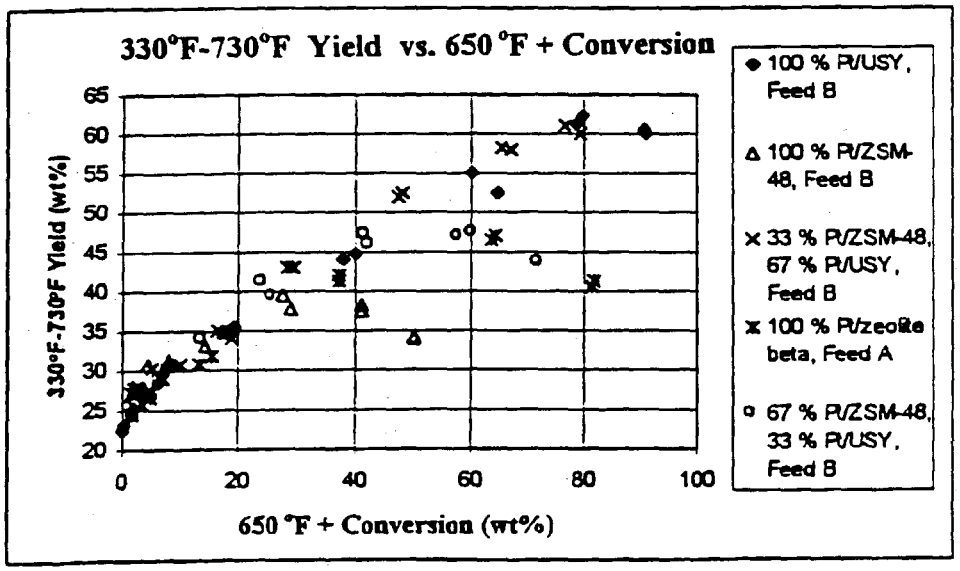
FIG. 8 is a plot of 330-730° F. Yield versus 650° F.+ Conversion for five different catalyst fills.

It has been found that when used in series with the Pt/USY catalyst, the distillate yields of the Pt/ZSM-48 catalyst are greatly improved. FIG. 8 shows that the 0.5:1 vol/vol ZSM-48/USY catalyst combination has a higher 330-730° F. yield than Pt/zeolite at typical IDW severity (above about 40 wt % 650° F.+ conversion). Another benefit of the 0.5:1 catalyst combination is that the product pour point is about 10° C. lower than the Pt/zeolite catalyst at 40 wt % conversion. The disadvantage lies in the catalyst activity. At 40 wt % conversion, Pt/zeolite is about 80° F. more active with respect to conversion and 60° F. more active with respect to product pour point (compared to the 0.5:1 ZSM-48/USY combination.)

Feedstock

The present process may be used to dewax a variety of feedstocks ranging from relatively light distillate fractions up to high boiling stocks such as whole crude petroleum, cycle oils, gas oils, vacuum gas oils, furfural raffinates, deasphalted residua and other heavy oils. The feedstock will normally be a $C_{10}$+ feedstock since lighter oils will usually be free of significant quantities of waxy components. However, the process is particularly useful with waxy distillate stocks to produce gas oils, kerosenes, jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.).

Hydrocracked stocks are a convenient source of stocks of this kind and also of other distillate fractions since they frequently contain significant amounts of waxy n-paraffins which have been produced by the removal of polycyclic aromatics. The feedstock for the present process will normally be a $C_{10}$+ feedstock containing paraffins, olefins, naphthenes, aromatics, and herterocyclic compounds, with a substantial proportion of high molecular weight n-paraffins and slightly branched paraffins which contribute to the waxy nature of the feedstock.

The waxy feeds which are most benefited by the practice of the present invention will have relatively high pour points, usually above 100° F., but feeds with pour points ranging from 50° F. to 150° F. may be used.

The hydrocarbon feedstock can be treated prior to hydrocracking in order to reduce or substantially eliminate its heteroatom content. As necessary or desired, the feedstock can be hydrotreated under mild or moderate hydroprocessing conditions to reduce its sulfur, nitrogen, oxygen and metal content. Conventional hydrotreating process conditions and catalysts can be employed, e.g., those described in U.S. Pat. No. 4,283,272, the contents of which are incorporated by reference herein.

Hydrocracking Catalyst

The hydrocracking catalyst used in the process can be any conventional distillate selective hydrocracking catalyst used in the art. Large pore hydrocracking zeolites are preferred, such as zeolite X (U.S. Pat. No. 2,882,244), zeolite Y (U.S. Pat. No. 3,130,007), zeolite USY (a low sodium Ultrastable Y molecular sieve, described in U.S. Pat. Nos. 3,293,192; 3,402,996; and 3,449,070). Zeolite USY is most preferred. Other cracking components include REY (Rare Earth Y, as described in U.S. Pat. No. 4,604,187), zeolite beta (U.S. Pat. No. 3,308,069), ZSM-12 (U.S. Pat. No. 3,832,449), ZSM-20 (U.S. Pat. No. 3,972,983), MCM-41 (U.S. Pat. Nos. 5,102,643 and 5,098,684), MCM-68, SAPO-37 (U.S. Pat. No. 4,440,871), and amorphous silica-alumina.

Highly siliceous forms of the hydrocracking catalyst are preferred. Various methods of reducing the silica to alumina ratio of the hydrocracking zeolite are known. In preferred embodiments using a USY component, the zeolite framework has a silica to alumina molar ratio of from about 30 to 1 to about 3000 to 1, with a preferred ratio of above about 100 to 1.

The conventional hydrocracking catalyst has a hydrogenation component. The hydrogenation component can be a Group VIII noble metal, preferably platinum, palladium, or a combination thereof. The amount of the hydrogenation component within the conventional hydrocracking catalyst will vary, typically between 0.1 and 1.5 wt %, preferably between 0.2 and 0.9 wt %. The hydrogenation component may be incorporated into the zeolite by any means known in the art, preferably impregnation or ion exchange.

Isomerization Dewaxing Catalyst

The isomerization catalyst used in the process can be any conventional isomerization dewaxing catalyst known in the art, provided that it isomerizes the feedstock, thereby reducing the pour point, at a conversion of less than about 40%. By isomerizing the feedstock at a lower conversion, the distillate selective hydrocracking catalyst produces a higher distillate yield with fewer gaseous by-products. If the isomerization occurs after a higher percentage of the feedstock is converted to distillate range product, the distillate yield will be further reduced to lighter fractions by the hydrocracking catalyst.

Acidic zeolite dewaxing catalysts are preferred for the process of the invention and the most preferred is ZSM-48, as disclosed in U.S. Pat. Nos. 4,397,827; 4,423,021; 4,448,675; 5,075,269; and 5,282,958, which are incorporated herein by reference.

Hydroprocessing Conditions

The feedstock is contacted with the hydrocracking catalyst and isomerization dewaxing catalyst in the presence of hydrogen under hydroprocessing conditions of elevated temperature and pressure. Conditions of temperature, pressure, space velocity, hydrogen to feedstock ratio and hydrogen partial pressure which are similar to those used in conventional hydrocracking operations can conveniently be employed herein.

Process temperatures of from about 400° F. to about 1000° F. can conveniently be used although temperatures above about 800 F. will normally not be employed as the reactions become unfavorable at temperatures above this point. Generally, temperatures of from about 570° F. to about 800° F. will be employed. Total pressure is usually in the range of from about 500 to about 20,000 kPa (from about 38 to about 2,886 psig) with pressures above about 7,000 kPa (about 986 psig) normally being preferred. The process is operated in the presence of hydrogen with hydrogen partial pressures normally being from about 100 to about 3,500 psi, with pressures from about 200 to about 3,000 being preferred. The hydrogen to feedstock ratio (hydrogen circulation rate) is normally from about 10 to about 3,500 $n.1.1^{-1}$ (from about 56 to about 19,660 SCF/bbl). The space velocity of the feedstock will normally be from about 0.1 to about 20 LHSV and, preferably, from about 0.2 to about 2.0 LHSV.

For many feedstocks, an implicit part of the hydrocracking process includes a hydrotreating step and associated hydrotreating catalyst to remove contaminants such as nitrogen, sulfur and various metals. Very heavy feedstocks often require some removal of asphaltenes and Conradson Carbon Residue (CCR).

Several types of hydroprocessing reactors can be used to practice the present invention. The most common configuration is a co-current, trickle flow reactor. Other reactors include a countercurrent flow reactor, an ebullated bed reactor and a moving bed reactor. The primary advantage of a countercurrent reactor is the removal of gas-phase heteroatom contaminants by countercurrent gas flow, thereby improving catalyst performance. In an ebullated bed reactor or a moving bed reactor, fresh catalyst can be continuously added and spent catalyst can be continuously withdrawn to improve process performance.

Within the same reactor, the hydrocracking catalyst and the dewaxing catalyst can be located in separate layers or comprise a mixed layer. A combination catalyst formed by coextruding the hydrocracking catalyst and the dewaxing catalyst can also be used. The ratio of hydrocracking catalyst to dewaxing catalyst can be varied to obtain the desired yield. The ratio of the catalysts will also vary based upon the feedstock and specific catalysts chosen. In general, the ratio of dewaxing catalyst to hydrocracking catalyst can vary over a wide range (i.e., from about 0.1:1 to about 10:1). The preferred ratio is dependent upon the refiner's processing objective of tailoring dewaxing versus conversion.

The conversion can be conducted by contacting the feedstock with a fixed bed of catalyst, a fixed fluidized bed or with a transport bed. A simple configuration is a trickle-bed operation in which the feed is allowed to trickle through a stationary fixed bed. With such a configuration, it is desirable to initiate the hydrocracking reaction with fresh catalyst at a moderate temperature which is raised as the catalyst ages in order to maintain catalytic activity. Another reactor configuration employs a countercurrent process, i.e., the hydrocarbon feed flows down over a fixed catalyst bed while the $H_2$ flows in the upward direction. The countercurrent configuration has the advantage that any autogeneous $H_2S$ or $NH_3$ are removed overhead, and the noble metal catalyst is less impacted by these poisons.

In a preferred embodiment, a feedstock, usually a heavy, waxy hydrocarbon, enters a catalytic dewaxing reactor where isomerization dewaxing using an acidic zeolite dewaxing catalyst, preferably ZSM-48, is carried out. The product, with a reduced wax content, is withdrawn and sent to distillation column. The distillation column separates the product into a relatively light fraction of $C_1$ to C4 hydrocarbons, a $C_5$ to 420° F. naphtha fraction, a distillate fraction, and a relatively heavy fraction, typically a 650° F.+ to 750° F.+ material. The heavy material, along with other feed and preferably with any resin fraction added to the unit, are then sent to a conventional fluid catalytic cracking (FCC) unit, which preferably includes a conventional riser reactor and catalyst regeneration unit.

The process and catalysts disclosed and claimed herein can be made and executed without undue experimentation in light of the present disclosure. While the process and catalysts of this invention have been described in terms of preferred embodiments, it will be apparent to those of skill in the art that variations may be applied without departing from the concept, spirit and scope of the invention. More specifically, the process operating parameters can be changed within the ranges disclosed herein and/or certain catalytic components, which are chemically related, may be substituted for the catalytic components described herein and the same or similar results will be achieved. All such similar changes and/or substitutes are deemed to be within the spirit, scope and concept of the invention as defined by the appended claims.

The following examples will illustrate the effectiveness of the presently claimed process and catalysts, but are not meant to limit the present invention.

EXAMPLES

Example 1

In order to demonstrate the present invention, Moderate Pressure Hydrocracker Bottoms were processed over five different fill ratios. The five catalyst fills examined were:

1. 100% Pt/ZSM-48
2. 67 vol % Pt/ZSM-48 and 33 vol % Pt/USY
3. 33 vol % Pt/ZSM-48 and 67 vol % Pt/USY
4. 100% Pt/USY
5. 100% Pt/zeolite beta Two different samples of the hydrocracked bottoms (Feedstocks A and B) were processed in accordance with the present invention using these five fill ratios. Table 1 below lists the properties for each feedstock.

TABLE 1

MODERATE PRESSURE HYDROCRACKER BOTTOMS PROPERTIES

| PROPERTY | FEEDSTOCK "A" | FEEDSTOCK "B" |
|---|---|---|
| API | 34.0 | 33.7 |
| Pour Point (C.) | 39 | 39 |
| Cloud Point (C.) | 43 | 48 |
| Sulfur, ppm | 30 | 29 |

TABLE 1-continued

| MODERATE PRESSURE HYDROCRACKER BOTTOMS PROPERTIES | | |
|---|---|---|
| PROPERTY | FEEDSTOCK "A" | FEEDSTOCK "B" |
| Nitrogen, ppm | 4 | 5 |
| Basic Nitrogen, ppm | 0 | 0.01 |
| D2887-IBP (F.) | 515 | 487 |
| 10% off | 665 | 663 |
| 30% off | 751 | 749 |
| 50% off | 805 | 803 |
| 70% off | 855 | 853 |
| 90% off | 916 | 915 |
| D2887-FBP | 993 | 1010 |

Table 2 below lists the major properties of each catalyst.

TABLE 2

| CATALYST PROPERTIES | | | |
|---|---|---|---|
| PROPERTY | Pt/USY | Pt/ZSM-48 | Pt/Zeolite |
| Zeolite | USY 24.28 Unit Cell Size | ZSM-48 | Zeolite |
| Zeolite Content, wt % | 65 | 65 | 65 |
| $Al_2O_3$ Content, wt % | 35 | 35 | 35 |
| Platinum, Wt % | 0.6 | 0.6 | 0.6 |
| Alpha Value | 30 | 20 | 50 |

The gas circulation rate for the experiments was twice the normal gas circulation rate in order to minimize aging while the catalyst was being tested. Table 3 below lists the operating conditions for the experiments.

TABLE 3

| OPERATING CONDITIONS | |
|---|---|
| OPERATING PARAMETER | VALUE |
| Pressure, psig | 400 |
| Space Velocity, $hr^{-1}$ | 0.7 |
| Gas Circulation Rate, scf/bbl | 4000 |
| Temperature, F. | 570–670 |

In addition to the study which processed Moderate Pressure Hydrocarbons Bottoms (Feedstocks A and B), a diesel fuel and a treated straight run gas oil (Feedstocks C and D) were processed using the process of the present invention. The feedstock properties for those two feeds are listed below in Table 4.

The feedstocks were processed and the results were recorded. These test results are presented in graph form in FIGS. 1 to 11.

FIG. 1 is a plot of the 650° F.+ Conversion versus the Reactor Temperature for five different catalyst fills. The graph shows the combination 33% Pt/ZSM-48 and 67% Pt/USY catalyst provides higher conversions at lower reactor temperatures than either catalyst used alone. However, the Pt/zeolite beta is still more active than the combination.

Figure 2:
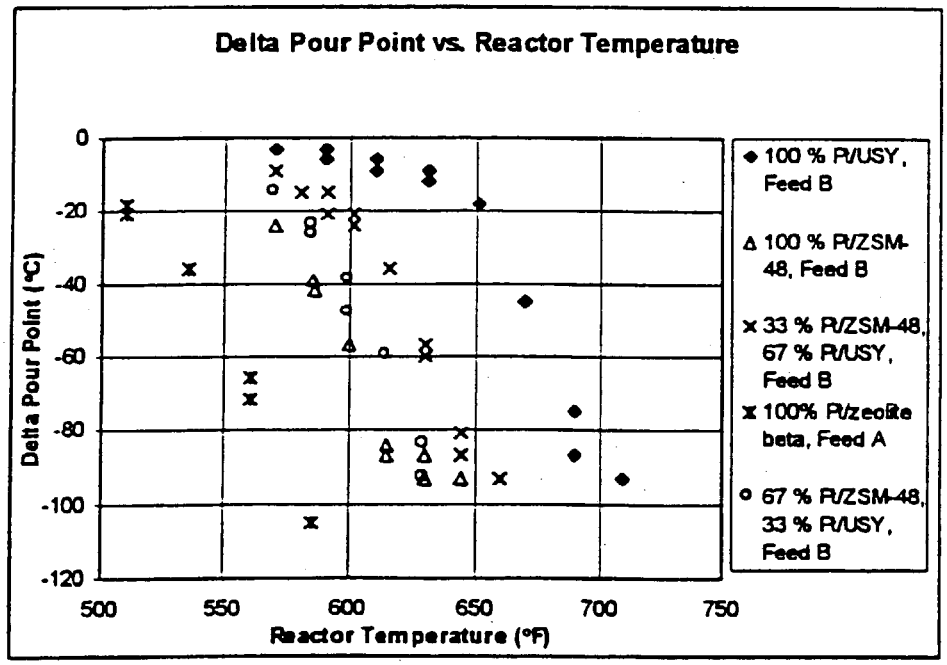
FIG. 2 is a plot of the Delta Pour Point versus the Reactor Temperature for five different catalyst fills.

FIG. 2 is a plot of the Delta Pour Point versus the Reactor Temperature for five different catalyst fills. The delta pour point is calculated by subtracting the feed pour point from the product pour point. The graph shows that the 100% Pt/USY catalyst produces the highest pour point while the 100% Pt/ZSM-48 and 100% Pt/zeolite beta catalysts produce relatively low pour points.

Figure 3:
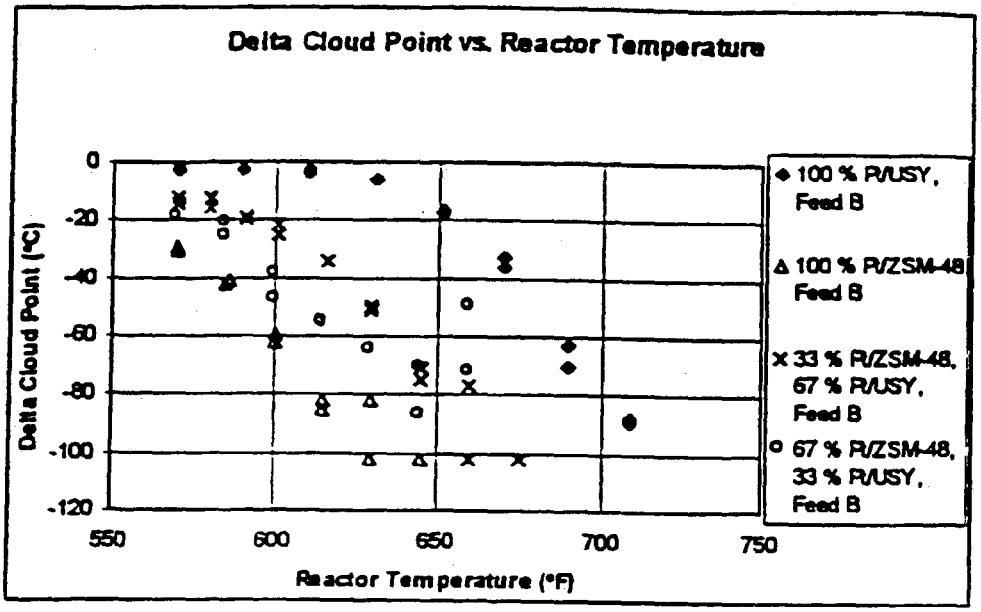
FIG. 3 is a plot of Delta Cloud Point versus Reactor Temperature for four different catalyst fills.

FIG. 3 is a plot of Delta Cloud Point versus Reactor Temperature for four different catalyst fills. The delta cloud point is calculated by subtracting the feed cloud point from the product cloud point. The graph shows that the 100% Pt/ZSM-48 catalyst provides the greatest delta cloud point decrease, followed by the 67% Pt/ZSM-48 and 33% Pt/USY combination catalyst and then the 33% Pt/ZSM-48 and 67% Pt/USY combination catalyst. The delta cloud points for all three catalysts decrease as the reactor temperature increases between 550° F. and 675° F.

FIG. 4 is a plot of Delta Pour Point versus 650° F.+ Conversion for five different catalyst fills. The advantage of reducing the pour point at low conversions lies in the resulting product yields. At higher conversions, more of the feedstock is converted to lower value naphtha and light gasses. The graph shows that the 100% Pt/ZSM-48 catalyst provides its greatest decrease in delta pour point at low 650° F.+ conversions from 10-30 wt %, while the 100% Pt/zeolite beta catalyst and the 33% Pt/ZSM-48 and 67% Pt/USY combination catalyst provide their greatest decrease in delta pour point at 650° F.+ conversions of from 30-75 wt %. The 100% Pt/USY catalyst has only a small effect on the pour point at 650° F.+ conversions below 30 wt %.

Figure 5:
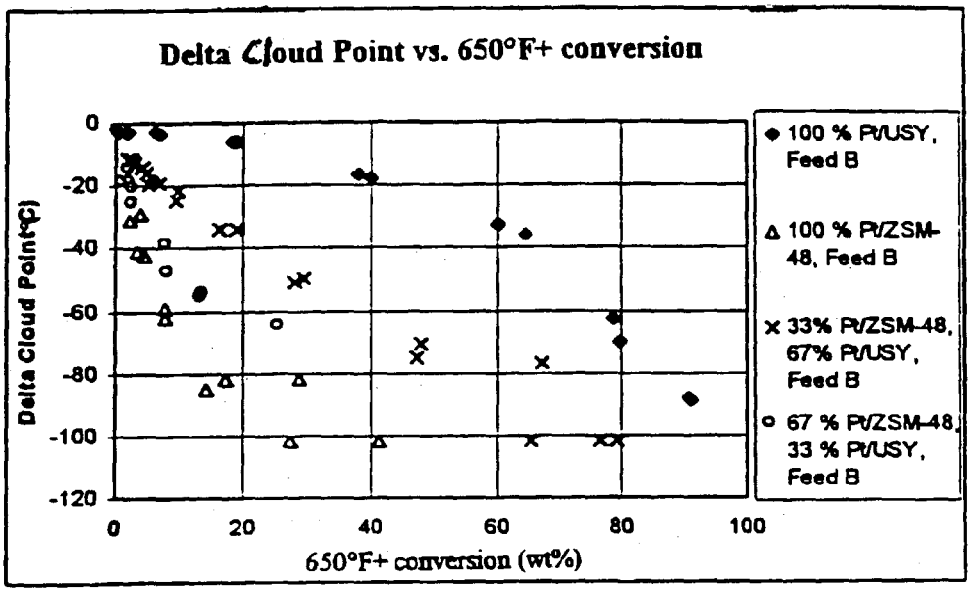
FIG. 5 is a plot of Delta Cloud Point versus 650° F.+ Conversion for four different catalyst fills.

FIG. 5 is a plot of Delta Cloud Point versus 650° F.+ Conversion for four different catalyst fills. The graph shows that the 100% Pt/ZSM-48 catalyst provides its greatest decrease in delta pour point at low 650° F.+ conversions of from 10-40 wt %, the 33% Pt/ZSM-48 and 67% Pt/USY combination catalyst provides its greatest decrease in delta pour point at 650° F.+ conversions of from 45-80 wt % and the 67% Pt/ZSM-48 and 33% Pt/USY combination catalyst provides moderate decreases in delta pour point at low 650° F.+ conversions of from 0-10 wt %.

Figure 6:
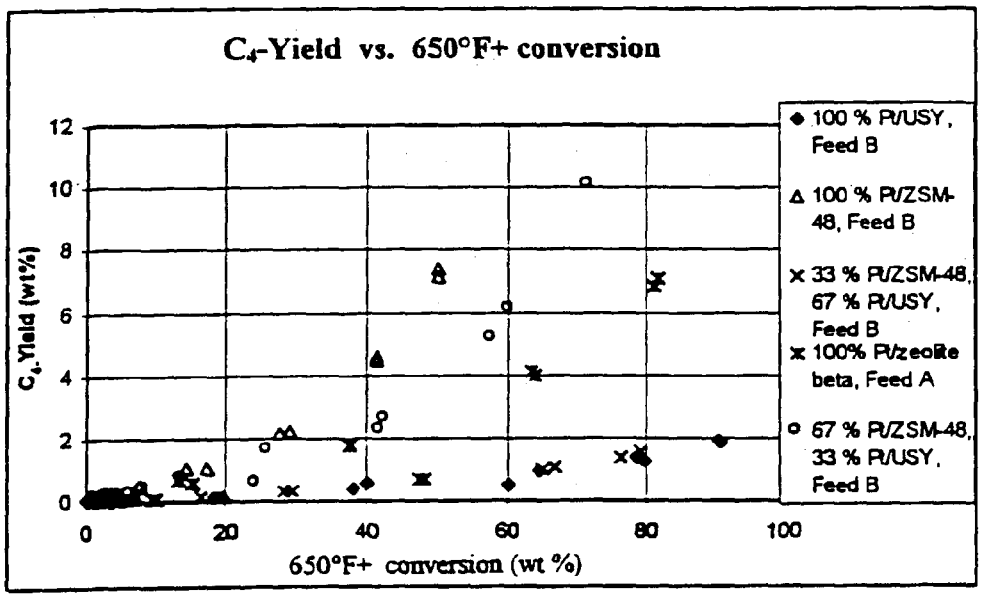
FIG. 6 is a plot of the $C_4$-Yield versus the 650° F.+ Conversion for five different catalyst fills.

FIG. 6 is a plot of the $C_4$-Yield versus the 650° F.+ Conversion for five different catalyst fills. The graph shows that the 100% Pt/USY catalyst produces a high $C_4$-yield at 650° F.+ conversions of between 40-50% and the 67% Pt/ZSM-48 and 33% Pt/USY combination catalyst produces a high $C_4$-yield at 650° F.+ conversions of between 50-70%, while the 100% Pt/zeolite beta catalyst provides increasing $C_4$-yields as the 650° F.+ conversions exceed 40 wt %. The other two catalysts show only moderate $C_4$-yields at 650° F.+ conversions between 0-80 wt %.

Figure 7:
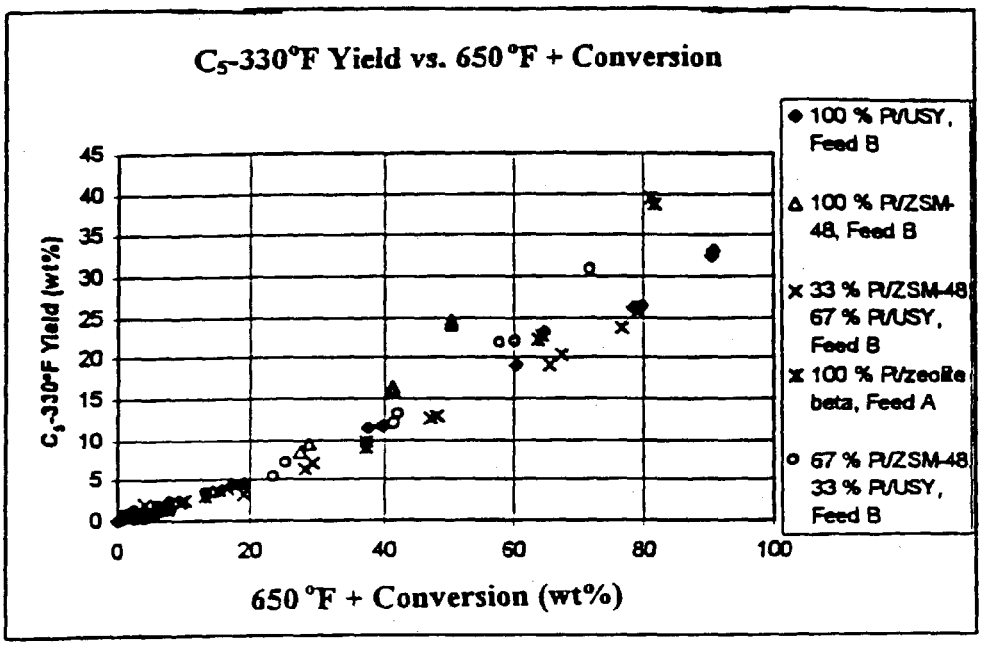
FIG. 7 is a plot of $C_5$-330° F. Yield versus 650° F.+ Conversion for five different catalyst fills.

FIG. 7 is a plot of $C_5$-330° F. Yield versus 650° F.+ Conversion for five different catalyst fills. The graph shows that the $C_5$-330° F. yields for all five catalysts gradually increase for 650° F.+ conversions between 0-50 wt %, while the 100% Pt/ZSM-48 catalyst provides the highest yields between 40-60% and the 67% Pt/ZSM-48 and 33% Pt/USY combination catalyst and the 100% Pt/zeolite beta catalyst provide high $C_5$-330° F. yields for 650° F.+ conversions above about 60 wt %.

FIG. 8 is a plot of 330-730° F. Yield versus 650° F.+ Conversion for five different catalyst fills. The graph shows that the 33% Pt/ZSM-48 and 67% Pt/USY combination catalyst and the 100% Pt/USY catalyst provide the greatest 330-730° F. yields for 650° F.+ conversions from 0-80 wt %. The other three catalysts have similar yields for 650° F.+ conversions below 40% and progressively lower yields for 650° F.+ conversions above 40 wt %.

Figure 9:
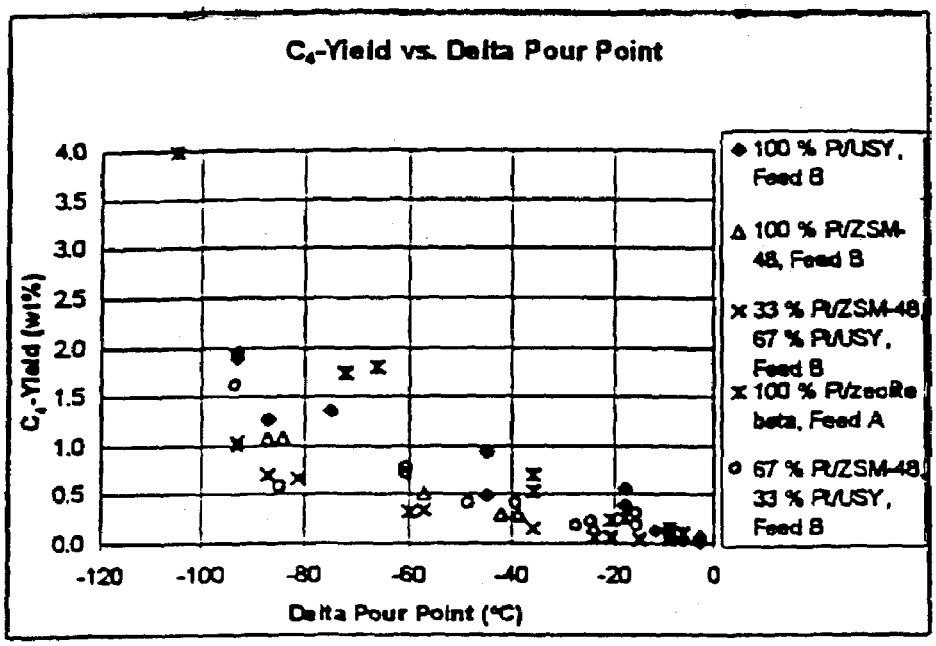
FIG. 9 is a plot of the $C_4$-Yield versus the Delta Pour Point for five different fills.

FIG. 9 is a plot of the $C_4$-Yield versus the Delta Pour Point for five different catalyst fills. The graph shows that the 100% Pt/USY catalyst and the 100% Pt/zeolite beta catalyst produce the highest $C_4$-yields and the yields continue to increase as the delta pour point decreases. The other three catalysts provide lower $C_4$-yields as the delta pour point decreases.

Figure 10:
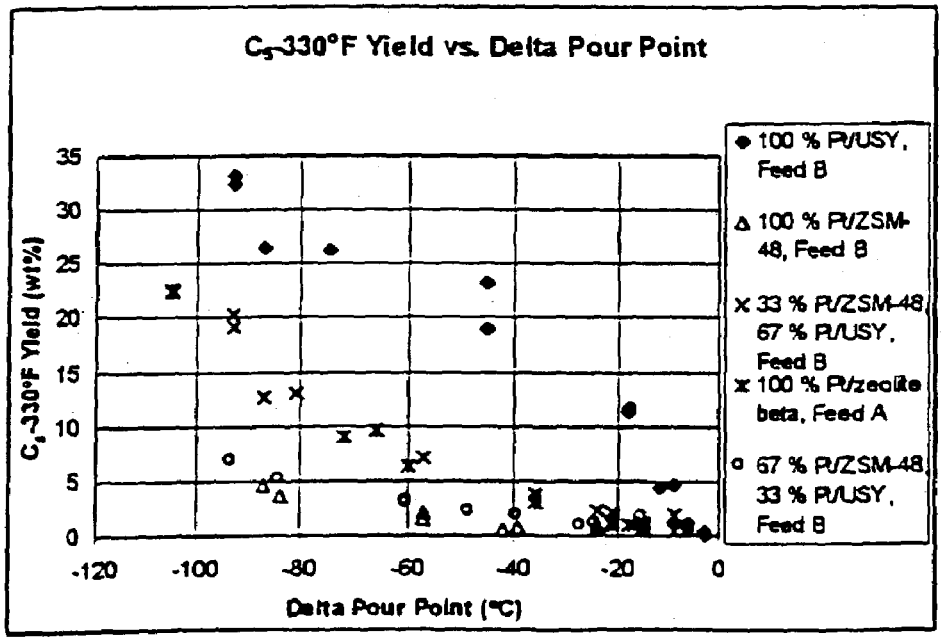
FIG. 10 is a plot of $C_5$-330° F. Yield versus Delta Pour Point for five different catalyst fills.

FIG. 10 is a plot of $C_5$-330° F. Yield versus Delta Pour Point for five different catalyst fills. The graph shows that the 100% Pt/USY catalyst provides the highest $C_5$-330° F. yield and the yield increases as the delta pour point decreases. The 100% Pt/zeolite beta catalyst and the 33% Pt/ZSM-48 and 67% Pt/USY combination catalyst produce the next highest $C_5$-330° F. yields as the delta pour point decreases while the other two catalysts have relatively low $C_5$-330° F. yields and show only small increases in yield as the delta pour point decreases.

Figure 11:
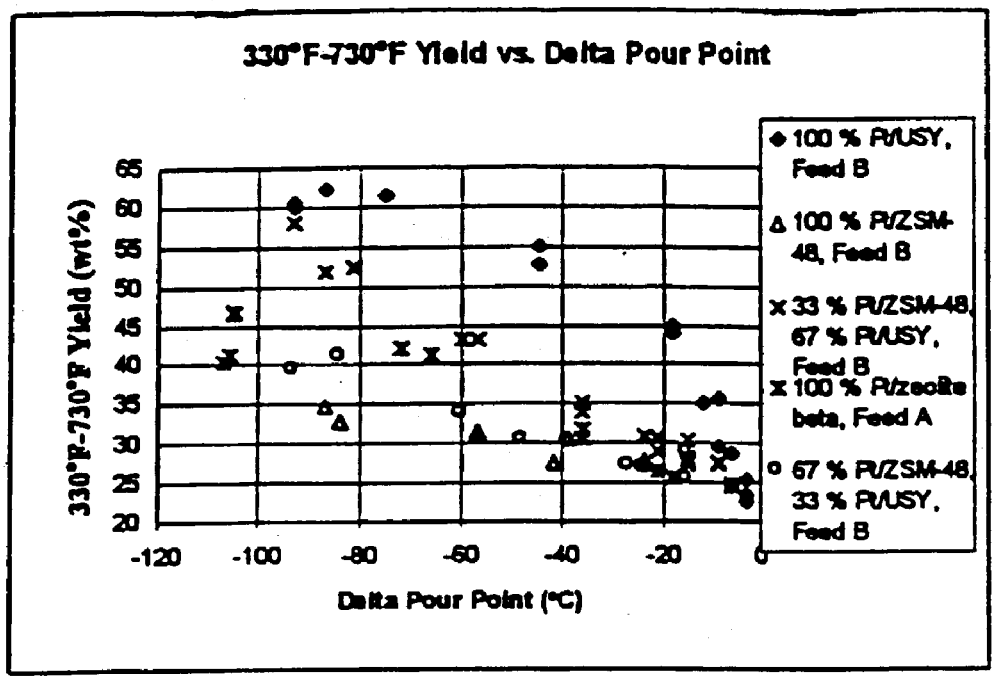
FIG. 11 is a plot of 330-730° F. Yield versus Delta Pour Point for five different catalyst fills.

FIG. 11 is a plot of 330-730° F. Yield versus Delta Pour Point for five different catalyst fills. The graph shows that the 100% Pt/USY catalyst provides the highest 330-730° F. yields and the yields increase as the for delta pour point decreases. The 33% Pt/ZSM-48 and 67% Pt/USY combination catalyst provides the next highest 330-730° F. yields, followed by the 100% Pt/zeolite beta catalyst. The other two catalysts have somewhat lower yields.

Example 2

The catalysts listed in Table 4 below were evaluated for hexadecane isomerization performance. All catalysts were exchanged with Pt except for catalyst number 5, which was impregnated. Experiments were carried out in a ½" diameter tubular down-flow trickle-bed reactor. The hexadecane was used as received from Aldrich Chemical Company. Each catalyst evaluated was extruded and then lightly pressed to provide a catalyst having a length to diameter ratio of less than 4. The catalysts were then loaded into the reactor, and sand (80/120 mesh) was added in a ratio of 0.3 cc of sand per cc of extrudate to fill any void spaces. After being loaded into the reactor, the catalysts were dried by passing 100% hydrogen through the reactor at 250° C. under atmospheric pressure for 2 hours. After drying, the hydrogen flow was terminated and the catalysts were presulfided by passing a mixture of 2% $H_2S$ in hydrogen through the reactor while the temperature was ramped from 250° C. to 370° C. and held there for about 2 hours. The reactor was then cooled to 250° C. and the 100% hydrogen flow was restored. The pressure was increased to 1000 psig, and the hexadecane was passed through the reactor at a flow rate of 2 liquid hourly space velocity (LHSV). The temperature was adjusted to identify the temperature at which 95% of the hexadecane is converted to other products the hexadecane flow rate was reduced to about 0.3 to about 0.4 LHSV. The results of these experiments are listed in Table 5 below.

It should be noted that "Max $iC_{16}$ yield" as used herein is meant to refer to the highest yield of total $C_{16}$ isomers as the n-$C_{16}$ conversion was varied from 0 to 100%.

It should be noted that "Temperature for 95% conversion" as used herein is meant to refer to that temperature required to convert 95% of the n-$C_{16}$ feedstock to other products.

TABLE 4

CATALYST DESCRIPTIONS

| Catalyst # | Catalyst | Weight % zeolite in extrudate | Metals loading (wt. %) | Alpha value prior to Pt loading |
|---|---|---|---|---|
| 1 | ZSM-5/$Al_2O_3$ | 80 | 0.44 Pt | 1 |
| 2 | ZSM-5/$Al_2O_3$ | 80 | 1.1 Pt | 8 |
| 3 | ZSM-11/$Al_2O_3$ | 65 | 0.1 Pt | 20 |
| 4 | ZSM-23/$Al_2O_3$ | 65 | 0.2 Pt | 30 |
| 5 | ZSM-23/$Al_2O_3$ | 65 | 1.0 Pt | 3 |
| 6 | ZSM-23/$Al_2O_3$ | 65 | 0.53 Pt | 1 |

TABLE 4-continued

CATALYST DESCRIPTIONS

| Catalyst # | Catalyst | Weight % zeolite in extrudate | Metals loading (wt. %) | Alpha value prior to Pt loading |
|---|---|---|---|---|
| 7 | ZSM-23/$Al_2O_3$ | 65 | 0.52 Pt | 30 |
| 8 | ZSM-35/$Al_2O_3$ | 65 | 0.6 Pt | 73 |
| 9 | ZSM-48/$Al_2O_3$ | 65 | 0.28 Pt | 5 |
| 10 | ZSM-48/$Al_2O_3$ | 65 | 0.6 Pt | 16 |

TABLE 5

SUMMARY OF HEXADECANE HYDROISOMERIZATION RESULTS

| Catalyst # | Catalyst | Temp for 95% Conversion, ° F. | Max $iC_{16}$ yield, wt. % |
|---|---|---|---|
| 1 | ZSM-5/$Al_2O_3$ | 603 | 42 |
| 2 | ZSM-5/$Al_2O_3$ | 554 | 30 |
| 3 | ZSM-11/$Al_2O_3$ | 550 | 23 |
| 4 | ZSM-23/$Al_2O_3$ | 570 | 49 |
| 5 | ZSM-23/$Al_2O_3$ | 626 | 45 |
| 6 | ZSM-23/$Al_2O_3$ | 603 | 47 |
| 7 | ZSM-23/$Al_2O_3$ | 547 | 42 |
| 8 | ZSM-35/$Al_2O_3$ | 535 | 33 |
| 9 | ZSM-48/$Al_2O_3$ | 619 | 75 |
| 10 | ZSM-48/$Al_2O_3$ | 554 | 89 |

As can be seen from the results contained in Table 5 above, ZSM-48 achieves a higher yield of $iC_{16}$ yield than any other intermediate pore zeolite tested.

What is claimed is:

1. A process for upgrading a hydrocarbon feedstock containing waxy components and having a cloud point greater than 0° F., an ASTM D2887 end boiling point exceeding 650° F., and a pour point greater than 0° F., wherein at least 10 wt. % of the feed which boils over 650° F. is converted to lower boiling products, and an overall distillate yield of greater than 10 wt. % occurs, said distillate having a boiling range of about 330° F. to 730° F., the product having a pour point and a cloud point which has been reduced by at least 5° F. from that of the feedstock, said process comprising the following steps:

(a) contacting said feedstock at superatmospheric hydrogen partial pressure with an isomerization dewaxing catalyst comprising ZSM-48 and a hydrogenation component, the hydrogenation component being Pt, Pd, or mixture thereof, to produce an isomerized product with a reduced wax content; and (b) contacting the isomerized product of step (a) with a distillate selective hydrocracking catalyst which comprises a noble metal hydrogenation component to upgrade said isomerized product with a reduced wax content to distillate.

2. The process for upgrading a hydrocarbon feedstock according to claim 1, wherein the pour point of said product is at least 10° F. lower than the pour point of said feedstock.

3. The process for upgrading a hydrocarbon feedstock according to claim 1, wherein said feedstock is a hydrotreated feedstock produced by contacting said feedstock with a suitable hydrotreating catalyst under effective hydrotreating conditions.

4. The process for upgrading a hydrocarbon feedstock according to claim 1, wherein said isomerization dewaxing catalyst and said hydrocracking catalyst are present in a physical mixture, are combined to form a single combination catalyst by coextrusion, or are stacked in a layered configuration.

5. The process for upgrading a hydrocarbon feedstock according to claim 1, wherein the volumetric ratio of said dewaxing catalyst to said hydrocracking catalyst is from about 0.1:1 to about 10 to 1.

6. The process for upgrading a hydrocarbon feedstock according to claim 1, wherein said process is carried out in a reactor selected from the group consisting of a co-current trickle flow reactor, a countercurrent flow reactor, an ebullated bed reactor and a moving bed reactor.

7. The process for upgrading a hydrocarbon feedstock according to claim 1, wherein said hydroprocessing conditions comprise a temperature of about 400-1000° F., a hydrogen partial pressure of about 200 to 3000 psi, a hydrogen circulation rate of about 100 to 10,000 SCF/bbl, and a liquid hourly space velocity of about 0.1 to 20.

8. The method of claim 1, wherein the distillate selective hydrocracking catalyst is zeolite X, zeolite Y, USY, ZSM-20, SAPO-37, zeolite beta, MCM-68, ZSM-12, REY, MCM-41, or amorphous silica-alumina.

9. The method of claim 1, wherein the distillate selective hydrocracking catalyst is USY.

* * * * *